US009917348B2

(12) United States Patent
Murphy

(10) Patent No.: US 9,917,348 B2
(45) Date of Patent: Mar. 13, 2018

(54) ANTENNA CO-LOCATED WITH PCB ELECTRONICS

(71) Applicant: Cisco Technology, Inc., San Jose, CA (US)

(72) Inventor: William Murphy, Lawrenceville, GA (US)

(73) Assignee: Cisco Technology, Inc., San Jose, CA (US)

( * ) Notice: Subject to any disclaimer, the term of this patent is extended or adjusted under 35 U.S.C. 154(b) by 482 days.

(21) Appl. No.: 14/153,754

(22) Filed: Jan. 13, 2014

(65) Prior Publication Data

US 2015/0200445 A1 Jul. 16, 2015

(51) Int. Cl.

| | |
|---|---|
| ***H01Q 1/38*** | (2006.01) |
| ***H01Q 1/24*** | (2006.01) |
| ***H01Q 9/04*** | (2006.01) |
| ***H01Q 23/00*** | (2006.01) |

(52) U.S. Cl.

CPC ..... *H01Q 1/243* (2013.01); *H01Q 1/38* (2013.01); *H01Q 9/0421* (2013.01); *H01Q 23/00* (2013.01)

(58) Field of Classification Search

CPC ..... H01Q 1/24; H01Q 1/526; H01Q 1/48

USPC ..... 343/700 MS, 702, 853

See application file for complete search history.

(56) References Cited

U.S. PATENT DOCUMENTS

| | | | | |
|---|---|---|---|---|
| 5,023,624 | A * | 6/1991 | Heckaman | H01L 23/66 333/247 |
| 6,307,520 | B1 * | 10/2001 | Liu | H01Q 23/00 343/702 |
| 6,339,400 | B1 * | 1/2002 | Flint | H01Q 1/22 343/702 |
| 6,483,466 | B2 * | 11/2002 | Liu | H01Q 23/00 343/702 |
| 6,573,869 | B2 | 6/2003 | Moore | |
| 6,686,886 | B2 * | 2/2004 | Flint | H01Q 1/22 343/700 MS |
| 6,781,547 | B2 | 8/2004 | Lee | |
| 6,853,336 | B2 * | 2/2005 | Asano | H01Q 1/22 343/702 |
| 6,950,069 | B2 * | 9/2005 | Gaucher | H01Q 1/24 343/700 MS |
| 6,985,108 | B2 * | 1/2006 | Mikkola | H01Q 1/243 343/700 MS |
| 7,012,571 | B1 * | 3/2006 | Ozkar | H01Q 1/243 343/702 |
| 7,053,844 | B2 * | 5/2006 | Gaucher | H01Q 9/0421 343/700 MS |
| 7,183,985 | B2 | 2/2007 | Tseng | |
| 7,482,982 | B2 * | 1/2009 | Jenwatanavet | H01Q 1/243 343/700 MS |

(Continued)

*Primary Examiner* — Peguy Jean Pierre

(57) ABSTRACT

A PIFA is formed using a grounding plane in a printed circuit board and a metal chassis or shield. Rather than using the printed circuit board as the separator, an air gap or other gap than the printed circuit board is formed. The transmitter and/or receiver for the antenna may be mounted to the printed circuit board. The feed pin routes signals for the PIFA from the transmitter and/or receiver to the metal chassis or shield while being isolated from the grounding plane that acts as the radiating surface of the PIFA. Standoffs supporting the printed circuit board may be used to short, and another standoff may be used as the feed pin.

20 Claims, 2 Drawing Sheets

(56) References Cited

U.S. PATENT DOCUMENTS

| | | | | |
|---|---|---|---|---|
| 7,495,629 | B2 * | 2/2009 | Parsche | H01Q 1/38 343/700 MS |
| 7,629,928 | B2 * | 12/2009 | Fabrega-Sanchez | G02B 27/62 343/700 MS |
| 8,725,095 | B2 * | 5/2014 | Li | H01Q 9/0421 455/129 |
| 2013/0120211 | A1 * | 5/2013 | Zhang | H01Q 1/245 343/841 |
| 2013/0154884 | A1 | 6/2013 | Cheng et al. | |
| 2014/0132457 | A1 * | 5/2014 | Galeev | H01Q 5/35 343/702 |
| 2014/0354494 | A1 * | 12/2014 | Katz | H01Q 1/273 343/718 |

* cited by examiner

ANTENNA CO-LOCATED WITH PCB ELECTRONICS

TECHNICAL FIELD

This disclosure relates in general to antennas and, more particularly, to antennas used with electronics.

BACKGROUND

Antennas present considerable mechanical packaging challenges. To place an antenna in a confined space with electronics may lead to sacrifices in antenna efficiency, frequency of operation, percentage bandwidth or other characteristics.

Dipole-type antennas are affected by the mechanical design of the chassis and electronics. Dipole antennas require physical separation between the antenna and any conductive metal, including the electronics on a printed circuit board. To space the antenna away from the chassis and electronics, a cable is typically used and the antenna is mounted on the non-metal packaging. Cables and separated antennas drive the size of the packaging larger and the cost of the antenna solution higher.

Inverted F antennas (IFA) and monopole antennas may be implemented in a printed circuit board. However, IFA and monopole antennas require a reserved area for the antenna to be isolated from the electronics of the printed circuit board. This drives up the size and cost of the printed circuit board and packaging.

Planar inverted F antennas (PIFA) may be implemented in several ways. Normally, PIFA are formed from thin metal, which is cut and bent precisely for operation at the desired frequency. Usually this type of antenna requires a cable for connection between the folded metal structure and transceiver circuit. For lower frequency operation, a larger area is needed since antenna size increases inversely with frequency. Thus, Bent-Metal PIFAs may be limited to frequencies above 2 GHz. At 2 GHz, the folded metal length is about 1.5 inches. In high volume small electronic products, folded metal antennas are problematic above that size. Folded metal and associated cables drive up the size and cost of the packaging.

PIFA antennas may also be implemented by using the top and bottom layers of a printed circuit board. Separate metal structures are formed in different layers of the printed circuit board to realize the PIFA. To provide the isolation from the electronic circuitry, a reserved area of the printed circuit board is used. But since the printed circuit board material is between the metal structures, the PCB-based PIFA suffers from poor efficiency due to the poor dielectric loss of the board material. The small thickness (e.g., 0.059 mils) also results in an extremely narrow bandwidth for the PIFA. Thus, the PCB-based PIFA is rarely used in practice.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts.

DESCRIPTION OF EXAMPLE EMBODIMENTS

Figure 1:
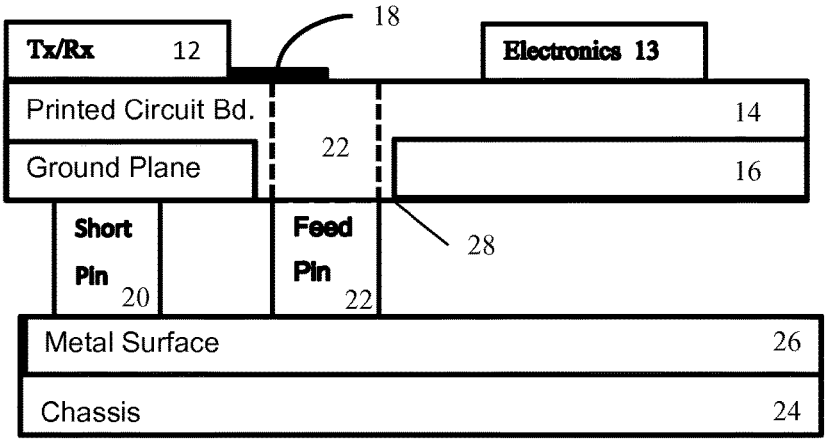
FIG. 1 is a cross-sectional view of one embodiment of an apparatus with a planar inverted F antenna (PIFA)

A PIFA is formed using a grounding plane in a printed circuit board and a metal chassis or shield. Rather than using the dielectric material of the printed circuit board as the separator, an air gap or other gap than the printed circuit board is formed, such as using a gap formed by mounting the printed circuit board to the chassis. The transmitter and/or receiver for the antenna may be mounted to the printed circuit board. The feed pin routes signals for the PIFA from the transmitter and/or receiver to the metal chassis or shield while being isolated from the printed circuit board grounding plane that acts as the radiating surface of the PIFA. Standoffs supporting the printed circuit board may be used to short, and another standoff may be used as the feed pin.

In one aspect, an apparatus is provided. A printed circuit board has a grounding plane. A transceiver is mounted on the printed circuit board. A chassis has a metal surface. The printed circuit board connects to the chassis by at least one shorting pin shorting the metal surface to the grounding plane and separating the printed circuit board from the metal surface by a gap. A feed pin electrically connects with the transceiver and the metal surface of the chassis. The feed pin is electrically isolated from the grounding plane. The grounding plane is a radiation surface of a planar inverted F antenna, and the transceiver is configured to operate the planar inverted F antenna through the feed pin.

In another aspect, a method includes routing a signal between an antenna circuit on a printed circuit board and a metal shield separated from the printed circuit board by a gap, shorting a metal radiating surface of the printed circuit board to the metal shield with at least one shorting pin, and isolating the metal radiation surface from the routing of the signal between the transceiver and the metal shield with a feed pin.

In yet another aspect, an apparatus includes a mounting surface for electronics. A planar inverted F antenna includes a transmitter or receiver mounted on the mounting surface, a grounding surface, a grounding plane of the electronics between the grounding surface and the mounting surface, the grounding surface separated from the grounding plane, standoff pins shorting the grounding plane to the grounding surface, and an antenna feed pin electrically connecting the mounting surface to the grounding surface.

The PIFA is connected in an opposite, backwards, or different arrangement as compared to a PIFA formed by folding multiple metal layers in a same printed circuit board. This different arrangement for the PIFA is backward from conventional implementations in the sense of the metal being driven or connected to the electronics. The feed pin connects to the ground surface rather than the radiating surface. This arrangement allows for co-locating the antenna and the electronics on the same circuit board, even a same area of the board. Using the chassis and ground plane of the printed circuit board as the two conductive surfaces, the antenna is realized with little additional cost. This arrangement also allows placement of the electronics anywhere on the printed circuit board rather than requiring reserved area of no electronics. Since PIFAs may be designed with an arbitrarily large grounding plane, and a metal chassis or large shield may serve as a grounding plane, the PIFA is not required to be isolated from metal. Since a reserved area is not needed and since rigid PCB material supports the PIFA structure, larger antennas may be formed. A PIFA may be designed for frequencies lower than 2 GHz. A PIFA may be designed for lower frequencies than for a same package as compared to using reserved area on the board. Although the printed circuit board is used as a radiating surface, the PIFA may not suffer from poor efficiency or narrow bandwidth since an air gap of any desired dimension rather the dielectric thickness of a printed circuit board separates the conductive surfaces.

FIG. 1 shows an apparatus with a PIFA. The apparatus is an electronics device, such as a cellular phone, tablet, computer, navigation device, set-top device, modem, cable box, gaming console, video player (e.g., DVD), consumer electronics, installation tool, or other device with electronics configured for wireless reception and/or transmission.

The apparatus includes electronics 13 (e.g., transceiver 12), a printed circuit board 14, spacer pins 20, 22, and a chassis 24. Additional, different, or fewer components may be provided. For example, brackets or other mounts are used instead of the spacer pins 20, 22. As another example, a shield, housing, case, support, or frame is provided instead of, as part of, or in addition to the chassis 24.

The electronics 13 are digital and/or analog electronics. For example, one or more application specific integrated circuits, processors, memories, resistors, capacitors, relays, diodes, chips, registers, filters, and/or other electronic devices are provided. The arrangement of the electronics 13 and interconnections is based on the product being implemented. Surface mounts, connectors, pads, or other devices may be provided.

The printed circuit board 14 is a sheet, plate, or slab of non-conductive material. Any circuit board material may be used, such as a non-conductive substrate of FR4 (e.g., glass-reinforced epoxy laminate). The printed circuit board 14 is rigid or semi-rigid. In alternative embodiments, flexible circuit material may be used. Any number of layers may be used, such as a single layer or multi-layer circuit board. The different layers are of the same size and shape, but may have different sizes and/or shapes. Any layer thickness may be used, such as from 0.050 to 0.1 mils.

The printed circuit board 14 is a mounting surface for the electronics 13 and transceiver 12. For example, a top surface of the printed circuit board 14 supports the electronics 13 and transceiver 12. The electronics 13 and transceiver 12 are mounted to the printed circuit board 14 by soldering and/or press fit. The printed circuit board 14 is printed with traces, such as the trace 18, for interconnecting the mounted electronics 13 and/or transceiver 12. Vias, layered tracing, or other electrical interconnection on the printed circuit board 14 may be used. The traces and electronics 13 are on one side of the printed circuit board 14, but may be on opposite sides (e.g., top and bottom mounts).

Figure 2:
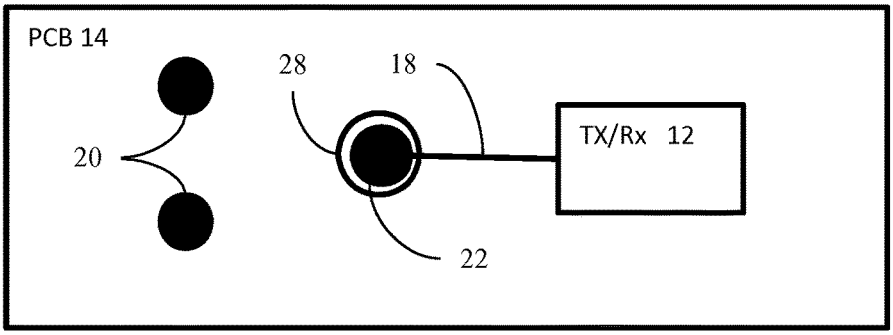
FIG. 2 is a top view of one embodiment of an apparatus with a PIFA.

The example trace 18 shown in FIGS. 1 and 2 electrically connects the transceiver 12 to the feed pin 22. The trace 18 is a metal structure, such as a layer of deposited copper, gold, or other conductive material on the printed circuit board 14. While shown as straight, the trace 18 may curve, include turns, or otherwise route along and/or within the printed circuit board 14.

The printed circuit board 14 may be formed, such as molded, cut, and/or drilled, to provide holes, a shape, or other structure. In one embodiment, two or more holes are provided for standoffs. For example, FIG. 1 shows two pins 20, 22 for mounting the printed circuit board 14 to the chassis 24. A hole is provided for each or some of the pins 20, 22. Holes, notches, indentations, extensions or other structure for guides, vias, or other electrical and/or mechanical connections may be provided.

The printed circuit board 14 includes one or more grounding planes 16. The grounding plane 16 is conductive material, such as a deposited layer of metal (e.g., copper). The grounding plane 16 is a mesh or continuous surface of any shape or size. In one embodiment, the grounding plane 16 covers an entire side or layer of the printed circuit board 14 with holes or shaping for any routing of signals through or beside the ground plane 16 without electrical connection to the ground plane 16. The ground plane 16 may be any now known or later developed ground plane 16 for use with electronics 13.

The ground plane 16 is on a side opposite or otherwise spaced away from the mounting surface supporting the electronics 13. For example, the ground plane 16 is a plating on a back side, bottom side, or interior layer of the printed circuit board. The ground plane 16 connects as a ground to the electronics 13, such as to ground pins of chips forming the electronics 13 and/or transceiver 12. The ground plane 16 provides a common ground for the electronics 13 and transceiver 12.

The components of the apparatus, other than the transceiver 12, are part of the device for implementing any intended function. Some of these components are also used to implement a planar inverted F antenna. A metal surface 26 of the chassis 24 provides one ground surface of the PIFA, the ground plane 16 of the printed circuit board 14 provides the radiating surface of the PIFA, and the pins 20, 22 provide the feed pin routing and the shorting between the ground surface of the PIFA and the radiating surface.

Due to the arrangement of the PIFA, the transceiver 12 is mounted to the mounting surface of the printed circuit board 14 with the other electronics 13. The transceiver 12 is mounted by soldering or other connection. In alternative embodiments, the transceiver 12 or portions of the transceiver 12 are on a separate circuit board or mount to another structure not directly contacting the printed circuit board 14.

The transceiver 12 includes a transmitter and a receiver, but may be only a transmitter or only a receiver in other embodiments. The transceiver 12 includes one or more chips with or without separate analog or digital devices. Traces, vias, or other electrical interconnections are formed on the printed circuit board 14 for electrical connection with the transceiver 12. For example, a via or trace is provided for connecting a ground pin of one or more chips of the transceiver 12 to the ground plane 16 of the printed circuit board 14. As another example, the trace 18 connects an input and/or output of the transceiver 12 to the feed pin 22.

The transceiver 12 is configured by electrical connection, programming, design, and/or circuit layout to operate the PIFA through the feed pin 22. The transceiver 12 may generate a waveform for application to the PIFA, such as application to the metal surface 26 through the feed pin 22. Based on control signals from the electronics 13, the transceiver 12 creates a transmission signal. Any waveform, such as a modulated carrier waveform at a desired frequency or coding, is generated for transmission from the PIFA. The transceiver 12 drives the PIFA by sending the signal from an output to the PIFA. The signal is transmitted over the trace 18, over the feed pin 22, and into the metal surface 26, causing the ground plane 16 to radiate a transmit signal.

The transceiver 12 is configured to receive signals through the feed pin 22. Signals received by the ground plane 16 are mirrored in the metal surface 26. The signals pass through the feed pin 22 to the trace 18 and into an input of the transceiver 12. The transceiver 12 receives the signal and extracts information from the signal, such as extracting information carried in the modulating waveform of the signal.

With PIFA antenna, the transceiver 12 on the topside of the printed circuit board 14 uses the PIFA for wireless transmission and/or reception. The electronics 13 and transceiver 12 are on the same printed circuit board 14 as the ground plane 16 operating as the radiating surface (e.g., electronics 13 on a top side with the ground plane on the bottom side). The electronics 13 and transceiver 12 do not change the properties of the antenna since the bottom side or ground plane 16 of the printed circuit board 14 is the radiating surface of the antenna. The topside circuitry has a negligible effect on the antenna. This allows the transceiver 12 and/or electronics 13 to be co-located with the antenna (e.g., electronics 13 in a same area as the antenna—grounding plane 16), avoiding any cabling or long transmission lines.

The grounding surface of the PIFA is spaced away from the printed circuit board 14. In the example of FIG. 1, the chassis 24 is used as the grounding surface. The chassis 24 is made from conductive metal or includes metal. This metal provides the metal surface 26 to act as the grounding surface of the PIFA. In other examples, a shield, housing, frame, or other metallic structure spaced away from the printed circuit board or at least the part of the printed circuit board with the ground plane 16 used as the radiating surface is used as the grounding surface.

The chassis 24 provides a large sheet of metal. For example, the chassis 24 is a metal box and/or frame work for supporting the printed circuit board 14. The chassis 24 itself may be a housing or is within a separate housing. Strips, mesh or other structures than a sheet may be used.

The grounding plane 16 of the printed circuit board 14 is between the metal surface 26 of the chassis 24 and the mounting surface for the electronics 13. A gap is provided between the grounding plane 16 and the metal surface 26 of the chassis 24. The metal surface 26 is separated from the grounding plane 16 by air and one or more pins 20, 22. Other non-conductive and/or dielectric material may be provided within the gap.

The metal surface 26 acts as a grounding surface for the PIFA and the grounding plane 16 acts as a radiating surface for the PIFA. The grounding plane 16 is a metal radiating surface for the PIFA as well as a grounding plane 16 for the electronics 13. In other embodiments, a separate radiating surface in addition to the grounding plane 16 is formed in or on the printed circuit board 14 to act as the radiating surface.

The gap is formed, in part, using one or more shorting pins 20. FIG. 2 shows two shorting pins 20. A single shorting pin 20 or three or more shorting pins 20 may be used.

The shorting pins 20 are conductors electrically connected with the grounding plane 16 and the metal surface 26. For example, the shorting pins 20 are metal standoffs. The standoffs are bolts, screws, beams, bars, or other metal structure for spacing the printed circuit board 14 from the chassis 24. The standoffs connect to the chassis 24, such as by screwing into the chassis 24, and the standoffs connect to the printed circuit board 14, such as by a bolt, nut, or other attachment. Traces or contact are used to establish electrical connections between the ground plane 16 and the metal surface 26. The electrical connection is direct or a short, but may include resistive, inductive, or capacitive components. The shorting pins 20 provide the shorting connections of the PIFA. In alternative embodiments, non-conductive pins form the gap and a conductive trace, cable, wire, or other conductor shorts the grounding plane 16 to the metal surface 26. Non-shorting pins may be used to structurally support the gap while not contributing to the operation of the PIFA.

The non-conductive gap between the two surfaces is filled with material other than, even if also including, printed circuit board material. For example, air is a better dielectric than FR4 of circuit board material. A better dielectric may increase efficiency of the PIFA as compared to a PIFA formed of metal layers sandwiching circuit board material.

The shorting pins 20 may be of any height, such as of a height to create an 8 mm or ½ inch gap. The shorting pins 20 establish, fix, and/or maintain the height of the gap (e.g., the minimum or average separation of the grounding plane 16 from the metal surface 26). Any height that fits within the packaging may be used, allowing for greater gaps than may be provided with a gap formed from circuit board material. The bandwidth of the PIFA may be designed based on the gap. A larger gap height or separation may allow for greater bandwidth.

The antenna feed pin 22 is of the same or different structure as the shorting pins 20. For example, the antenna feed pin 22 is also a metal standoff. An additional standoff serves as the conductor for the feed point of the PIFA. The antenna feed pin 22 electrically connects the transceiver 12 to the metal surface 26 of the chassis 24.

The feed pin 22 is electrically isolated from the grounding plane 16. For example, an isolation gap 28 is formed, cut, etched or otherwise created in the grounding plane 16. The isolation gap 28 prevents electrical contact of the metallic standoff operating as the feed pin 22 with the grounding plane 16. The grounding plane 16 includes a hole or region of no conductor around the feed pin 22. As a result, an electrical connection of the grounding plane 16 with the feed pin 22 is avoided. Conversely, the shorting pins 20 do not have isolation gaps and may rest against at least part of the grounding plane 16. The only electrical connection between the ground plane 16 as the radiating surface and the metal surface 26 as the grounding surface of the PIFA are the shorting pins 20. The feed pin 22 connects with the mounting surface of the printed circuit board and electrically connects with the trace 18, such as overlapping on a pad connected with the trace 18.

The feed point is driven or connected in a reverse direction from conventional PIFA designs. Rather than feeding to the grounding plane 16, the feed is to the metal surface 26 spaced from the grounding plane 16 of the printed circuit board 14 by the gap. With this reversed arrangement, electronics 13, including the transceiver 12, may be placed on the printed circuit board 14 also hosting the radiating surface.

FIG. 2 shows another embodiment of a PIFA on an apparatus. Multiple shorting pins 20 are used and spaced relative to the grounding plane 16 and the feed pin 22. Performance or operation of the PIFA is set, in part, by placement of the shorting pins 20 relative to the feed pin 22 and the radiating surface of the grounding plane 16. The feed pin 22 is closer to a center of the grounding plane 16 than the shorting pins 20. All of the shorting pins 20 are on a same half of the grounding plane 16 at a same distance from the feed pin 22 and at a same distance from one or more edges of the grounding plane 16. In one embodiment, the feed pin 22 conceptually divides the radiating surface into a larger area portion on one side and a smaller area portion on another side, but may be centered in the grounding plane 16. The shorting pins 20 are positioned in the smaller area. For example, the shorting pins 20 are 2.8 inches from one short edge and 3.9 inches from the other short edge of the grounding plane 16. The shorting pins 20 are positioned a desired distance and orientation from each other and the feed pin 22. In other embodiments, fewer shorting pins 20 and/or different relative positioning of the shorting and feed pins 20, 22 are provided. The shorting pins 20 may each be a different distance from the feed pin 22 and/or edges of the grounding plane 16.

By positioning the shorting pins 20 relative to the feed pin 22, which routes the radio frequency energy to or from the antenna, the frequency, impedance, and/or other operating characteristic of the PIFA is controlled. The PIFA is designed for operation at a specific frequency by constraining the size of the bottom side ground plane 16, the placement of the shorting pins 20, the placement of the feed pin 22, and the height of the gap (e.g., height of the pins 20, 22). Theoretically, the PIFA may be designed to operate at any center frequency. Due to the size constraints of the printed circuit board, the size of the grounding plane 16 and the relative placements of the shorting pins 20 and feed pin 22 may be limited. Since reserved area free of electronics 13 is not needed, the available ground plane 16 is larger for a given size of printed circuit board 14. As a result, for a printed circuit board that may have only provided 2 GHz or higher frequency, sub-1 GHz frequency may be possible. Operation in sub-1 GHz to 3 GHz PCB may be practical in a printed circuit board 14 with eleven inches of length and four inches in width. For example, an operation frequency of 915 MHz may be used with about 6.5-7.0 inches of length of the ground plane 16. As another example, a 433 MHz antenna is provided with an 11 inch long printed circuit board 14 and corresponding ground plane 16.

The PIFA may be designed to maintain a 50 ohm input impedance. The gap, pin placement, and radiating surface size may be configured to provide the desired impedance. The relative placement between the feed pin 22 and the short pins 20 provide the way to configure impedance. Larger input impedances may be achieved by increasing the distance between the feed pin 22 and the short pins 20. Conversely, smaller input impedances may be achieved by decreasing the same distance. The ground plane size, air gap width, and relative placement of the pins may be modeled, the model may be used to create the desired characteristics, such as impedance. Other input impedances for the PIFA may be used.

In other embodiments, a dual antenna is possible. Additional shorting pins 20 and feed pins 22 with a same radiating surface and grounding surface configure the PIFA to operate as two antennas. In other embodiments, separate radiating surfaces and/or grounding surfaces are used. Other variations may be provided using the chassis or metal surface spaced from the printed circuit board for feeding the antenna.

Figure 3:
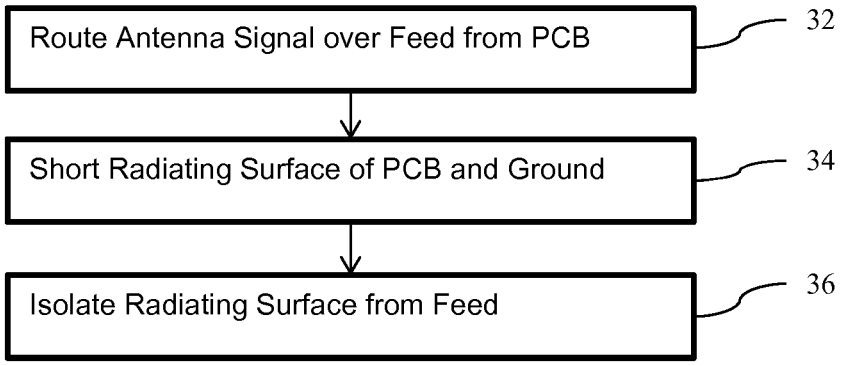
FIG. 3 is a flow chart diagram of one embodiment of a method for operating an antenna.

FIG. 3 shows a method for operating an antenna, such as a PIFA. The method is implemented using the PIFA antenna of FIG. 1, FIG. 2, or another antenna. Rather than perform the acts for operating a PIFA antenna, the method may be provided for any antenna now known or later developed.

Additional, different, or fewer acts may be provided. For example, separate acts are provided for transmitting and receiving. For transmitting, a transmitter drives the PIFA using the routing of act 32. For receiving, a receiver receives signals from the PIFA using the routing of act 32.

The method is directed to use of the antenna with a given structural arrangement. In other embodiments, a method of manufacture is provided where the same acts are used, but from a context of creating the structure rather than use. For example, routing is the act of connecting the transceiver through the feed pin to the metal surface, shorting is the act of connecting the shorting pins to the printed circuit board from the chassis, and isolating is the act of connecting the feed pin in a way that the ground plane of the printed circuit board does not make electrical contact with the feed pin.

The acts are performed in the order shown (top to bottom) or a different order. In one embodiment, the acts are performed simultaneously.

In act 32, a signal is routed between an antenna circuit on a printed circuit board and a metal shield separated from the printed circuit board by a gap. The gap includes air or a region of material other than the printed circuit board.

The signal is routed by traveling over a conductive path. The conductive path connects the antenna circuit with the metal shield. For example, a metallic standoff pin supporting the printed circuit board over the metal shield is electrically connected to the antenna circuit and the metal shield. A trace, pad, overlapping contact, bonded wire, via, and/or other conductive structure may be used to form the connection. For example, a cap, nut or part of the mounting for the standoff pin rests against a pad or trace of the printed circuit board once installed. A trace extends from the contact to the antenna circuit. For the metal shield, the standoff pin screws into the metal shield for structural support as well as electrical contact. The conductive route is a feed for the antenna.

The antenna circuit is a transmitter, receiver, or transceiver. To route the signal in transmit, the antenna circuit is driving the metal shield through the feed pin. A transmit signal is output from the antenna circuit, travels through the feed pin, and is applied to the metal shield. The signal applied to the metal shield causes the radiating surface on the other side of the gap to radiate the transmit signal. Relative to the metal shield, the transmit output does not vary substantially in potential. Since the radiating surface is also the ground for the transmitter circuit, the transmitter ground varies in potential relative to the transmitter. To route the signal in receive, the radiating surface receives a signal causing the radiating surface to vary in potential relative to the metal shield. The receiver input is connected through feed pin 22 to the metal shield. Relative to the metal shield, the receiver input does not vary substantially in potential. But since the radiating surface is also the ground for the receiver circuit, the receiver ground varies in potential relative to the receiver input. Thus, signals from the radiating surface are received by the antenna circuit.

In act 34, the metal radiating surface of the printed circuit board is shorted to the metal shield. One or more electrical connections between these two surfaces of the antenna short them together. The short or shorts are placed to provide the desired operating characteristics of the antenna.

In one embodiment, the shorting is performed by one or more (e.g., two) metal standoffs. At least some of the standoffs supporting the printed circuit board above or adjacent to the metal shield are conductive and electrically connect the metal shield to the radiating surface (e.g., grounding plane of a printed circuit board).

In act 36, the radiating surface is electrically isolated from the routing of the signal of act 32. Rather than feed the radiating surface, the metal shield is fed through the feed pin. This feed does not directly electrically connect with the radiating surface. Instead, the feed is through a hole in or around a side of the radiating surface. A trace of the printed circuit board connects to the feed pin, which connects to the metal shield. An isolation gap in the metal radiation surface of the printed circuit board prevents direct electrical contact of the radiating surface with the feed pin. The isolation gap is a region of no conductor. By the feed pin passing through the isolation gap and metal radiation surface, direct electrical connection is avoided.

By operating the antenna with a feed to the metal shield rather than the radiating surface on the printed circuit board, the antenna circuit may be positioned on the printed circuit board. By using the standoffs for the feed pin and shorting pins, the ground plane of the printed circuit board as the radiating surface, and the metal shield (e.g., housing, chassis or supporting frame) as another metal surface for the antenna, components already within an electronics product form the antenna, limiting costs. This arrangement also creates an air gap rather than a gap formed just between layers of a printed circuit board, allowing for greater efficiency for the antenna.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

What is claimed is:

1. An apparatus comprising:

a printed circuit board having a grounding plane;

a transceiver mounted on the printed circuit board and grounded to the grounding plane of the printed circuit board for grounding of the transceiver, wherein the grounding plane of the printed circuit board includes a radiation surface of a planar inverted F antenna;

a chassis comprising a frame work or box having a metal surface, the metal surface of the frame work or box being a ground surface of the planar inverted F antenna, the printed circuit board connected to and supported by the chassis by a spacer pin and at least one shorting pin shorting the metal surface to the grounding plane and separating the printed circuit board from the metal surface by a gap; and a feed pin electrically connected with the transceiver and the metal surface of the chassis, the feed pin electrically isolated from the radiation surface of the planar inverted F antenna and configured to drive the metal surface of the frame work or box;

wherein the transceiver is configured to operate the planar inverted F antenna with radio frequency signals through the feed pin connected to the metal surface of the frame work or box.

2. The apparatus of claim 1, wherein the printed circuit board comprises a non-conductive substrate with a metal trace, the metal trace connecting the transceiver to the feed pin, and the non-conductive substrate including a hole through which the feed pin connects the metal trace to the metal surface.

3. The apparatus of claim 1, wherein the transceiver comprises a ground pin connected with the grounding plane.

4. The apparatus of claim 1, wherein the chassis comprises a metal housing, the metal surface being the metal housing.

5. The apparatus of claim 1, wherein the at least one shorting pin comprises two or more shorting pins, each of the shorting pins comprising metal standoffs.

6. The apparatus of claim 5, wherein the two or more shorting pins are disposed on a same half of the grounding plane.

7. The apparatus of claim 6, wherein the two or more shorting pins are disposed at a same distance from the feed pin and at a same distance from one or more edges of the grounding plane.

8. The apparatus of claim 1, wherein the gap comprises an air gap.

9. The apparatus of claim 1, wherein the feed pin comprises a metal standoff.

10. The apparatus of claim 1, wherein the transceiver is configured to operate the planar inverted F antenna through the feed pin by driving the metal surface.

11. The apparatus of claim 1, wherein the transceiver is mounted on a first surface of the printed circuit board and the radiation surface of the planar inverted F antenna is on a second surface of the printed circuit board, the second surface being opposite to the first surface.

12. An apparatus comprising:

a mounting surface for electronics, the mounting surface being at a first surface of a substrate; and a planar inverted F antenna comprising:

a transmitter or receiver mounted on the mounting surface of the substrate;

a grounding surface disposed on a chassis structure;

a radiating surface being at a second surface of the substrate, the radiating surface being a grounding plane of the electronics and disposed between the grounding surface of the planar inverted F antenna and the mounting surface, the grounding surface being separated from the grounding plane;

one or more standoff pins disposed between the substrate and the chassis structure and being configured to short the grounding plane of the electronics to the grounding surface; and an antenna feed pin electrically connecting the transmitter or receiver on the mounting surface to the grounding surface.

13. The apparatus of claim 12, wherein the transmitter or receiver comprises a transceiver.

14. The apparatus of claim 12, wherein the antenna feed pin penetrates through the substrate to connect to a metal trace on the mounting surface, the metal trace being connected to the transmitter or receiver.

15. The apparatus of claim 12, wherein the substrate is a printed circuit board.

16. The apparatus of claim 12, wherein the grounding surface comprises a metal shield formed on the chassis and separated from the grounding plane by an air gap.

17. The apparatus of claim 12, wherein the antenna feed pin is isolated from the radiating surface of the planar inverted F antenna by a gap.

18. The apparatus of claim 12, wherein the antenna feed pin is disposed closer to a center of the radiating surface of the planar inverted F antenna than the one or more standoff pins.

19. The apparatus of claim 12, wherein the one of more standoff pins include a plurality of standoff pins, the plurality of standoff pins being disposed on a same half of the grounding plane.

20. The apparatus of claim 19, wherein the plurality of standoff pins are disposed at a same distance from the antenna feed pin and at a same distance from one or more edges of the grounding plane.

* * * * *